US009267237B2

(12) United States Patent
Hentze et al.

(10) Patent No.: US 9,267,237 B2
(45) Date of Patent: Feb. 23, 2016

(54) METHOD OF MANUFACTURING PAPER AND PRODUCTS OBTAINED BY THE METHOD

(75) Inventors: Hans-Peter Hentze, Espoo (FI); Jenni Sievanen, Helsinki (FI); John Kettle, Helsinki (FI); Artem Kulachenko, Taby (SE); Antti Korpela, Helsinki (SE); Jukka Ketoja, Espoo (FI); Erkki Hellen, Vantaa (FI); Tuomo Hjelt, Helsinki (FI); Jaakko Hiltunen, Kaunianinen (FI); Eila Turunen, Espoo (FI); Asko Sneck, Kirkkonummi (FI)

(73) Assignees: UPM-Kymmene Corporation, Helsinki (FI); STORA ENSO OYJ, Helsinki (FI)

( * ) Notice: Subject to any disclaimer, the term of this patent is extended or adjusted under 35 U.S.C. 154(b) by 217 days.

(21) Appl. No.: 13/376,689

(22) PCT Filed: Jun. 7, 2010

(86) PCT No.: PCT/FI2010/050467

§ 371 (c)(1),
(2), (4) Date: Feb. 15, 2012

(87) PCT Pub. No.: WO2010/142846

PCT Pub. Date: Dec. 16, 2010

(65) Prior Publication Data

US 2012/0132380 A1 May 31, 2012

(30) Foreign Application Priority Data

Jun. 8, 2009 (FI) ..... 20095634

(51) Int. Cl.

| | |
|---|---|
| ***D21F 11/00*** | (2006.01) |
| ***D21H 11/18*** | (2006.01) |
| ***D21H 21/18*** | (2006.01) |
| ***D21H 11/20*** | (2006.01) |
| ***D21H 15/02*** | (2006.01) |
| ***D21H 17/63*** | (2006.01) |
| *D21H 11/12* | (2006.01) |
| *D21H 21/28* | (2006.01) |
| *D21H 21/30* | (2006.01) |

(52) U.S. Cl.

CPC ..... *D21F 11/00* (2013.01); *D21H 11/18* (2013.01); *D21H 11/20* (2013.01); *D21H 15/02* (2013.01); *D21H 17/63* (2013.01); *D21H 11/12* (2013.01); *D21H 21/28* (2013.01); *D21H 21/30* (2013.01)

(58) Field of Classification Search

CPC ..... D21H 11/18; D21H 11/12; D21H 11/20; D21H 15/02; D21H 21/28; D21H 21/30; D21H 27/63; D21H 7/631; D21F 11/00; B32Y 30/00

USPC ..... 162/100, 102, 141, 149, 158, 181.1; 977/701, 706, 890, 893, 963

See application file for complete search history.

(56) References Cited

U.S. PATENT DOCUMENTS

| | | | | |
|---|---|---|---|---|
| 4,125,429 | A * | 11/1978 | Hergert et al. | 162/123 |
| 5,935,382 | A * | 8/1999 | Huovila et al. | 162/123 |
| 5,964,983 | A * | 10/1999 | Dinand et al. | 162/27 |
| 6,074,523 | A * | 6/2000 | Mizobuchi et al. | 162/91 |
| 7,381,294 | B2 * | 6/2008 | Suzuki et al. | 162/9 |
| 7,509,961 | B2 * | 3/2009 | Saoud et al. | 131/284 |
| 8,287,695 | B2 * | 10/2012 | Kim et al. | 162/388 |
| 8,317,978 | B1 * | 11/2012 | Manning et al. | 162/152 |
| 8,647,470 | B2 * | 2/2014 | Esser | 162/157.6 |
| 8,663,426 | B2 * | 3/2014 | Fujiwara et al. | 162/157.7 |
| 2002/0117283 | A1 * | 8/2002 | Soderholm et al. | 162/203 |
| 2005/0051487 | A1 | 3/2005 | Koslow | |
| 2005/0067730 | A1 | 3/2005 | Yano et al. | |
| 2007/0207692 | A1 | 9/2007 | Ono et al. | |
| 2008/0093042 | A1 * | 4/2008 | Skoog et al. | 162/212 |
| 2009/0264036 | A1 * | 10/2009 | Yano et al. | 442/165 |
| 2010/0000693 | A1 * | 1/2010 | Champ et al. | 162/123 |
| 2010/0065236 | A1 | 3/2010 | Henriksson et al. | |
| 2012/0048495 | A1 * | 3/2012 | Mannes | 162/336 |
| 2012/0094953 | A1 * | 4/2012 | Gane et al. | 514/57 |
| 2012/0132380 | A1 * | 5/2012 | Hentze et al. | 162/141 |
| 2012/0132381 | A1 * | 5/2012 | Hentze et al. | 162/149 |
| 2012/0216718 | A1 * | 8/2012 | Berglund et al. | 106/487 |
| 2015/0044415 | A1 * | 2/2015 | Read | D21H 11/18 428/116 |
| 2015/0158955 | A1 * | 6/2015 | Graveson | C08B 15/02 162/76 |
| 2015/0184345 | A1 * | 7/2015 | Nelson | D21H 21/32 435/139 |
| 2015/0204017 | A1 * | 7/2015 | Nelson | C08B 15/08 435/99 |

FOREIGN PATENT DOCUMENTS

| | | | |
|---|---|---|---|
| EP | 1036799 | A1 | 9/2000 |
| EP | 1 769 836 | A1 | 4/2007 |

(Continued)

OTHER PUBLICATIONS

Machine Translation of JP 10-248872, published on Sep. 1998.*
Machine Translation of JP 11-106403, published on Apr. 1999.*
H. Holik (Ed.), Additives Influencing the Quality and Printability of the Paper Surface) Part of the book: Handbook of Paper and Board, Weinheim, Wiley-VCH Verlag GmbH & Co., 2006, pp. 121-127.
Marielle Henriksson, et al., "Cellulose Nanopaper Structures of High Toughness", Biomacromollecules, 2008, pp. 1579-1585, vol. 9, No. 6.
Office Action Summary of Japanese Office Action dated Oct. 28, 2014 issued in Patent Application No. 2012-513648.

*Primary Examiner* — Jose Fortuna
(74) *Attorney, Agent, or Firm* — Sughrue Mion, PLLC

(57) ABSTRACT

The invention relates to a method for manufacturing nanostructured paper or board and a novel paper or board. The method comprises providing a liquid suspension of nanocellulose-containing material, forming a web from the suspension, and drying the web in order to form paper or board. According to the invention the water content of the suspension from which the web is formed is 50% or less by weight of liquids. By means of the invention, energy consumption of paper manufacturing can be significantly reduced.

20 Claims, 4 Drawing Sheets

(56) References Cited

FOREIGN PATENT DOCUMENTS

| | | | | |
|---|---|---|---|---|
| JP | 10-248872 | A | | 9/1998 |
| JP | 10-248872 | A | | 9/1998 |
| JP | 11-106403 | A | | 4/1999 |
| JP | 2006-193858 | A | | 7/2006 |
| JP | 2010-007010 | A | | 1/2010 |
| WO | WO 0052261 | A1 | * | 9/2000 |
| WO | WO 2004022844 | A1 | * | 3/2004 |
| WO | 2006/004012 | A1 | | 1/2006 |
| WO | WO 2008047255 | A1 | * | 4/2008 |
| WO | WO 2010142845 | A1 | * | 12/2010 |
| WO | WO 2010142846 | A1 | * | 12/2010 |

* cited by examiner

METHOD OF MANUFACTURING PAPER AND PRODUCTS OBTAINED BY THE METHOD

CROSS REFERENCE TO RELATED APPLICATIONS

This application is a National Stage of International Application No. PCT/FI2010/050467 filed Jun. 7, 2010, claiming priority based on Finland Patent Application No. 20095634 filed Jun. 8, 2009, the contents of all of which are incorporated herein by reference in their entirety.

FIELD OF THE INVENTION

The invention relates to paper making. In particular, the invention relates to novel method of manufacturing paper or board and products obtainable by the method. Generally, in such method, there is provided a liquid suspension of cellulose-containing material, a web is formed from the suspension, and the web is dried in order to form paper or board.

BACKGROUND OF THE INVENTION

For more than 200 years the conventional papermaking process is based on a filtration process of aqueous suspensions of woodfibers. Due to the large flocculation tendency, which can cause optical inhomogenities in the final paper structure, typically low consistencies of about 0.5-2% (by weight) woodfibers are used in paper furnishes. A large part of the production energy is consumed by the drying process, as water forms typically about 50% (by weight) of the wet web structure after filtration and pressing, and has to be evaporated in the drying section of the process.

Paper-like products have also been manufactured from non-cellulosic raw materials (e.g. ViaStone or FiberStone). Such products may consist of 80% calcium carbonate and 20% synthetic polymer resin, for example. By such materials, water consumption can be reduced or even avoided.

In certain applications, woodfibers have been replaced with nanocellulose as the raw material. This enables opportunities for new products, and new papermaking processes.

Henriksson et al, *Cellulose Nanopaper Structures of High Toughness, Biomacromolecules,* 2008, 9 (6), 1579-1585 discloses a porous paper comprising a network of cellulose nanofibrils. The preparation of the paper starts from nanofibril-water suspension, where the water is removed so that a cellulose nanofibril network is formed. First, a 0.2% (by weight) stirred water suspension is vacuum filtrated in a filter funnel. The wet films obtained is dried under heat and pressure. Porosity of the product was increased by exchanging the water as a solvent for methanol, ethanol or acetone before drying.

US 2007/0207692 discloses a nonwoven transparent or semitransparent highly porous fabric containing microfibrillated cellulose. The fabric can be obtained by a similar process as in the abovementioned article of Henriksson et al. by forming a web from aqueous suspension of microfibrillated cellulose, exchanging the water solvent for organic solvent and drying. According to the examples, the consistency of the aqueous suspension is 0.1% (by weight) before web-forming. Both the abovementioned methods utilize nanocellulose fibers that are smaller in size than the cellulose fibers (wood fibers) used in conventional paper making. Sheets manufactured from nanocellulose fibers are reported to have high toughness and strength. However, due to their transparency and/or porosity they are not very suitable as such for printing purposes, for example.

In addition, there is a need for more efficient methods of manufacturing paper, paperboard or the like products from nanocellulose.

SUMMARY OF THE INVENTION

It is an aim of the invention to produce a novel method for manufacturing nanocellulose-containing products and a novel nanocellulose-containing paper, paperboard or paper- or paperboard-like product (for simplicity, hereinafter referred to as "paper") which can be manufactured with reduced water consumption.

In addition, it is an aim of the invention to achieve a method reducing the energy consumption of paper making.

According to a first aspect of the invention, there is provided a method where paper is manufactured by forming a web directly from a non-aqueous suspension, and drying the web for obtaining paper. The consistency of the suspension can be as high as 0.5-90% (by weight), in particular 1-50% by weight, preferably at least 3% (by weight). The non-aqueous suspension comprises at least 50% (by weight) organic solvent. In addition to the reduced amount of liquid, energy savings are achieved because the heat of vaporization of such solvents is typically lower than that of water.

It has been found by the inventors, that owing to the small particle size, flocculation of the nanofibers is about negligible for the optical homogeneity of the final web structure. This enables the use of suspensions with higher consistencies and high consistency web forming. Another advantage of the use of nanocelluloses compared to conventional woodfibers is the immense increase of contact points of the formed fiber web, which enables the use of non-aqueous suspensions. Due to the reduced fiber-fiber interaction, woodfibers do not form any comparable, mechanically stable paper structures from typical non-aqueous (e.g. alcoholic) suspensions. In contrast, mechanically stable, porous and highly opaque paper-like web structures can be formed from alcoholic suspensions of cellulose nanofibers. Owing to a lower evaporation energy, the drying of nanocellulose webstructures from alcoholic suspensions is much more energy efficient compared to water-based web formation processes. Due to the much higher number of binding sites, also higher porosities and mechanical stabilities can be achieved using the same amount of nanocellulose compared to woodfibers, which allows reduction in raw materials use and higher contents of filler particles.

It has also been found by the inventors that cellulose particles with a high specific surface area form mechanically stable sheet-like structures (like paper) also from non-aqueous systems (e.g. ethanolic suspensions). This is a great improvement as compared with conventional sheets made from non-aqueous suspensions using wood-fibers, which do not hold together very well due to the much lower surface area of the much larger wood-fibers and the resulting much lower contact area.

The potential of the described new papermaking process compared to the conventional papermaking process is about 100% water savings, 60% energy savings, and 30-50% raw materials savings.

According to a preferred embodiment, the average pore size of the product is between 200 and 400 nm. According to a further embodiment, at least 30% of the volume of the pores of the paper or board is contained in pores having a size between 200 and 400 nm. This ensures that high opacity is achieved at all wavelengths of visible light.

It has also been found that when the paper or board is dried from non-aqueous suspension, a product having an opacity of 85% or more, in particular 90% or more, and even 95% or more can be produced even without any opacifying additives. In other words, the web is dried from non-aqueous mass which is rich in nanocellulose fibers. The suspension typically comprises at least 50%, in particular at least 75%, preferably 95% (by weight) organic solvent, such as alcohol. The inventors have found that such suspensions significantly contribute to achieving high opacity, the screening of fiber-fiber interactions takes place and capillary forces are considerably reduced during the drying process. Thus, pore structures in the range of 200-400 nm can be achieved, the range being about half of the wavelength of the visible light (400-800 nm). While pores below 100 nm and above 800 nm do not scatter light efficiently, the light scattering is optimal exactly in this pore size range of half of the wavelength of visible light. In contrast, water-based nanocellulose papers are dense and therefore are not opaque but transparent, as will be shown later by experimental data. On the other hand, known nanocellulosic sheets are too porous and transparent to be used as a substitute for paper, e.g. in printing applications.

According to another aspect of the invention, there is provided a novel paper comprising a network of nanocellulose fibers and reinforcing macrofibers and inorganic filler as additives.

According to one embodiment, the high-consistency non-aqueous suspension or the paper formed, contains 10-90% (by weight of solids), in particular 25-75% additives such as macrofibers (in contrast to nanofibers) and/or filler. The macrofibers are preferably organic macrofibers, such as wood fibers used in conventional paper making. Macrofibers have been found to have a significant reinforcing effect on the paper. The filler is preferably organic (e.g. cellulosic) or inorganic filler such as pigment, in particular mineral pigment. The pigment may have an opacifying effect on the paper.

The opacity of the product is preferably at least 85%, in particular at least 90%, preferably at least 95%.

According to one embodiment, the amount of organic macrofibers is 1-30% (by weight of solids), in particular 1-10%.

According to one embodiment, the amount of filler is 10-75% (by weight of solids), in particular 25-75%.

According to one embodiment, the suspension contains hydrophobization agent, such as sizing agent. The content of such agent can be, for example, 0.1-5% by weight. For example, alkenyl-succinic anhydride (ASA), can be used as the hydrophobization agent, in particular in the amount of 1-3 wt-%. One purpose of the hydrophobization agent is shielding of fiber-fiber interactions by hydrogen bonding and adjusting the porosity and/or bulk of the end product. Another purpose of the hydrophobization agent is to adjust the hydrophobic/lipophilic interactions for improved wettability, which is of importance in printing applications.

Organic solvent-based suspensions are compatible also with most other conventional additives used in papermaking.

According to a preferred embodiment, the porosity of the product is in the range of 10-50%, which is considerably smaller than achieved in US 2007/0207692 and allows the product to be used in printing applications, for example.

Generally, manufacturing of the paper or board according to the invention, can comprise the following steps:

- non-aqueous suspension is conveyed from suspension container to means for forming a web from the non-aqueous suspension,
- the formed web is conveyed to drying zone for solvent removal,
- the dried web is guided out of the drying zone for storage, and
- optionally, solvent is collected (e.g. condensed) at the drying zone and recovered or circulated back to the process.

The grammage of the resulting paper is preferably 30-160 g/m$^2$ and the grammage of the resulting board is preferably 120-500 g/m$^2$.

Definitions

The term "nanocellulose" in this document refers to any cellulose fibers with an average diameter (by weight) of 10 micrometer or less, preferably 1 micrometer or less, and most preferably 200 nm or less. The "cellulose fibers" can be any cellulosic entities having high aspect ratio (preferably 100 or more, in particular 1000 or more) and in the above-mentioned size category. These include, for example, products that are frequently called fine cellulose fibers, microfibrillated cellulose (MFC) fibers and cellulose nanofibers (NFC). Common to such cellulose fibers is that they have a high specific surface area, resulting in high contact area between fibers in the end product. The term "nanocellulose-based" paper or board means that the paper or board comprises a continuous network of nanocellulose fibers bound to each other so as to form the backbone of the paper or board.

The terms "macrofibers" ("woodfibers") refer to conventional (wood-originating) cellulose fibers used in papermaking and falling outside the abovementioned diameter ranges of nanocellulose.

The term "non-aqueous suspension" refers to content of water in the suspension of 0.01-50%, typically 0.01-20%, in particular 0.01-5%, by weight of the total liquid phase of the suspension. Thus, the majority of the liquid phase of the suspension is other liquid than water, for example alcohol. In practice, a minor amount of water is contained in all technical qualities of organic solvents, such as alcohols. This is, in fact, necessary, as a small amount of water is needed for the hydrogen bonding of the nanofibers. However, even a water content of significantly less than 1% (by weight) is sufficient.

The term "high consistency" of suspension refers to a consistency significantly higher than the cellulose suspension of conventional paper making, in particular a consistency of 5% (by weight) or more. Although high consistency suspension is preferred due to the reduced need of liquid removal and increased runnability, it is to be noted that the invention can generally be applied to low-consistency suspensions too. The preferred consistency range is about 0.05%-90%, in particular about 1-50% (by weight).

The term "filler" includes all non-fibrous raw materials which can be bound to the pores of a nanocellulose-containing web. In particular, such materials comprise pigments, such as mineral and/or polymer pigments, optical brighteners and binders. Examples of pigments are particles selected from the group consisting of gypsum, silicate, talc, plastic pigment particles, kaolin, mica, calcium carbonate, including ground and precipitated calcium carbonate, bentonite, alumina trihydrate, titanium dioxide, phyllosilicate, synthetic silica particles, organic pigment particles and mixtures thereof.

Next, embodiments and advantages of the invention will be discussed in more detail with reference to the attached drawings.

DETAILED DESCRIPTION OF EMBODIMENTS

Figure 1:
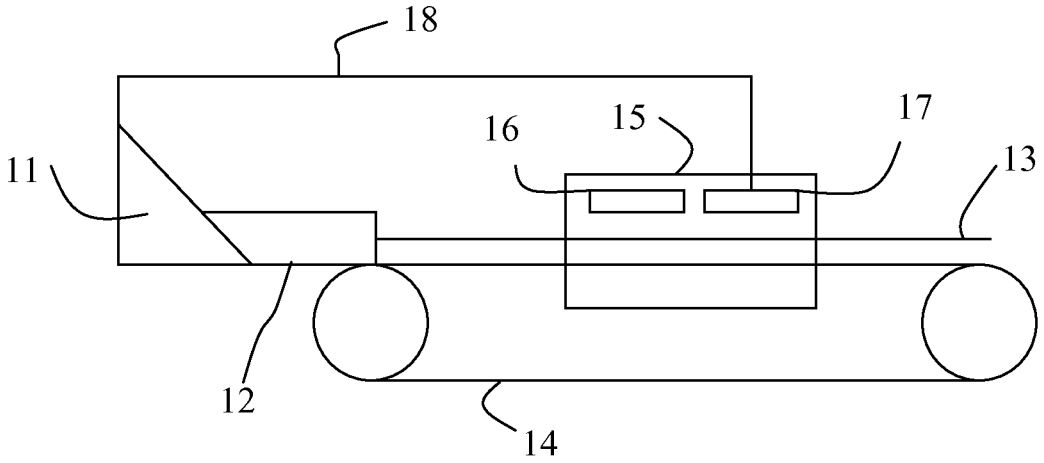
FIG. 1 illustrates schematically manufacturing apparatus according one embodiment.

The invention describes water-free paper production processes based on nanocelluloses, and sheet-like products made by these processes. The term water-free refers to cellulose suspensions which are not water-based (e.g. including hydrocarbon solvent, such as bio-ethanol). Low amounts of water can be still present, as it is typically the case in technical qualities of alcohols. The water-content of the liquid phase of the cellulose suspension has to be lower than 50%, preferably below 5% (by weight).

According to one embodiment, the relative permittivity of the solvent is at least 10 (e.g. ethanol: 24).

The process is characterized by the use of non-water based suspensions, which can be used at moderately high to high consistencies between 0.5% and 90%, preferably between 1 and 50%, typically 3-20% (by weight). High consistency of the suspension in the beginning of web-forming process minimizes the need of solvent removal/circulation and thus energy consumption. High-consistency organic solvent based forming thus has major positive economic and environmental effects. In conventional wood fiber-based paper making, high-consistency forming has required special high consistency formers, which have a different operating principle as in conventional low-consistency forming. Organic solvents have a significant effect on the rheology of the suspension and broaden the consistency range of conventional forming techniques at paper mills.

The specific area of the nanocellulose used within the invention is preferably at least 15 $m^2/g$, in particular at least 30 $m^2/g$. The cellulose fibers may be prepared from any cellulose-containing raw material, such as wood and/or plants. In particular, the cellulose may originate from pine, spruce, birch, cotton, sugar beet, rice straw, sea weed or bamboo, only to mention some examples. In addition, nanocellulose produced partly or entirely by bacterial processes can also be used (bacterial cellulose).

As concerns the manufacturing of nanocellulose, we refer to methods known per se, for example, as disclosed in US 2007/0207692, WO 2007/91942, JP 2004204380 and U.S. Pat. No. 7,381,294. The aqueous suspensions obtained by such method can be converted to non-aqueous suspensions within the meaning of the present invention by solvent exchange. However, it is also possible to produce directly alcoholic suspensions of nanocelluloses, e.g. by grinding ethanolic suspensions of dry pulp.

The web formation process can be performed by filtration of the non-aqueous suspension, e.g. vacuum filtration on a porous support, or by drying of the wet web structure on a non-porous support, e.g. belt drying, or by combinations of these methods.

The drying of the web can be performed by employing thermal energy, e.g. IR irradiation, or generating thermal energy in the wet web structure, e.g. microwave drying. Belt drying as the preferred drying process enables 100% retention of the raw material and of any additives to improve product performance or processibility. Combinations or cascades of different drying techniques may also be employed.

Further possible process steps can be included, such as condensation and circulation of the solvent, and calandering or wetting of preformed sheets e.g. for the formation of layered structures.

As organic solvents are more expensive than water, recovery or circulation of the removed solvent is a preferred option.

FIG. 1 shows schematically the manufacturing process according to one embodiment of the invention. In the process, non-aqueous suspension is conveyed from suspension container 11 to high-consistency (>1%) web former 12. The formed web 13 is conveyed using a belt conveyer 14, through drying zone 15 containing a drier 16 and solvent condenser 17. Dried web is guided out of the drying zone for storage. From the solvent condenser 17, the liquid solvent is circulated back to the suspension container 11 through a circulation conduit 18.

According to a preferred embodiment of the invention, there is provided as a starting material a nanocellulose-based furnish including inorganic filler particles as additives. The range of filler content is typically 1-90%, preferably 10-75% (by weight). As nanocellulose-based paper structures prepared from such furnishes have relatively low tensile stiffness compared to conventional paper (see Table 2, FIG. 2), wood fibers can be used as an additional additive to improve both tensile stiffness and tear strength. The wood-fiber content ranges from 1 to 30%, preferably from 1 to 10% (by weight).

Figure 2:
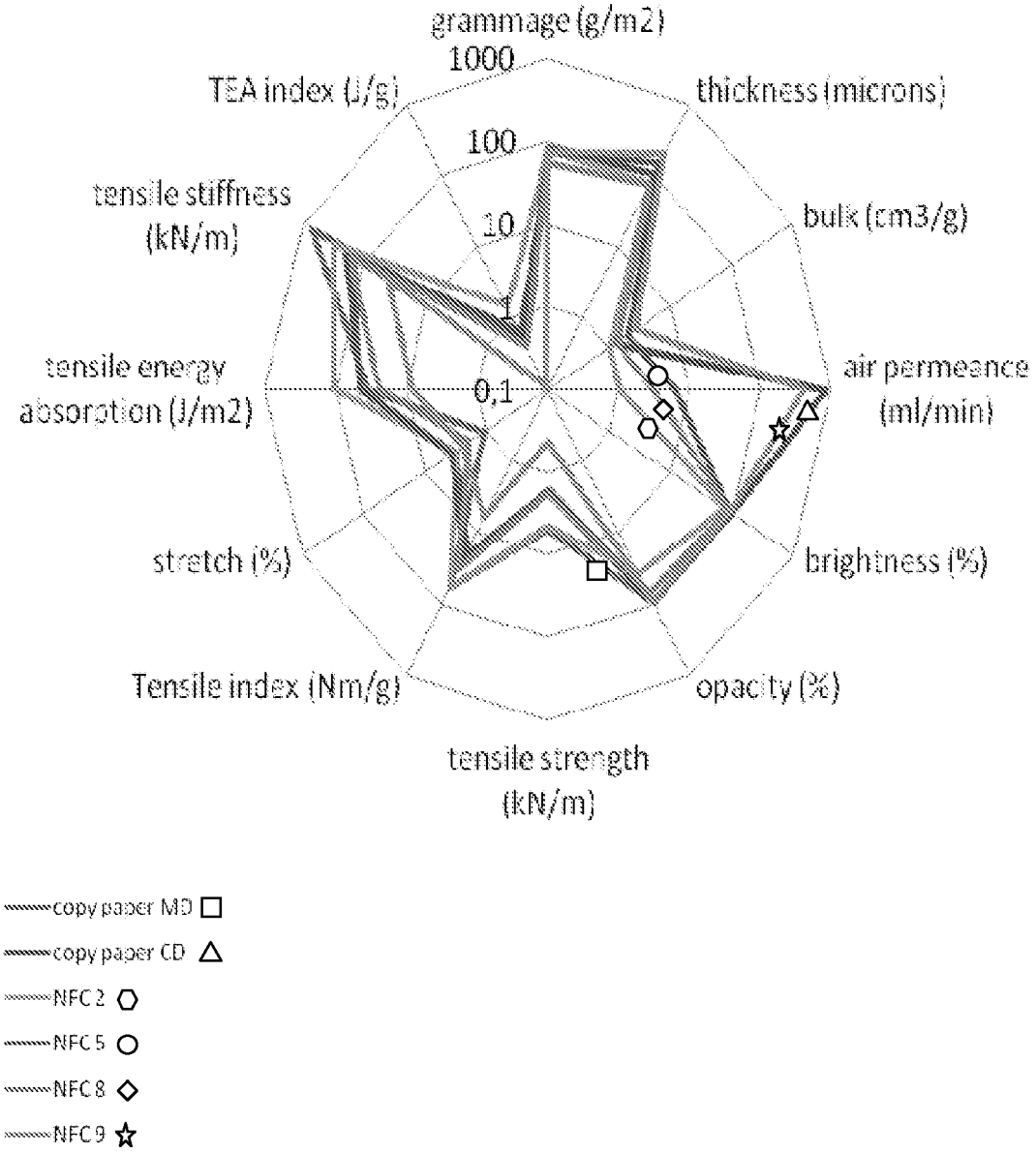
FIG. 2 shows measured properties of exemplary ethanol suspension-based nanocellulose papers, conventional copy paper and aqueous suspension-based nanocellulose papers.

The preparation from non-aqueous furnishes is compatible also with other additives used in papermaking, e.g. sizing agents which can be used for nanofiber hydrophobization (see Table 2 and FIG. 2). Hydrophobized nanofibers can be used for adjusting the porosity, bulk and/or hydrophobic/lipophilic interactions. Thus, the formed paper or board can be designed suitable for high quality printing applications, in which the porosity and wettability, in particular, must be in a desired range.

According to one advantageous embodiment, the present nanocellulose-based paper comprises 25-75% (by weight) nanocellulose fibers,
1-30% (by weight) reinforcing macrofibers, and
0-75% (by weight) fillers,
0-10% (by weight) other additives, the total amount of components amounting to 100%.

EXAMPLES

Table 1 shows examples (target values) of nanocellulose-based papers including additives (filler and wood-fibers). The filler used for the samples shown in Table 1 was ground calcium carbonate (GCC) (Hydrocarb HO, supplied by Omya, Finland). Reinforcing wood fibers were obtained from bleached birch Kraft pulp. All listed compositions have been found to be processable from non-aqueous suspensions and to the porosity range according to the invention.

TABLE 1

| | Grammage ($g/m^2$) | Filler amount (wt-%) | Reinforcing fibres (wt-%) |
|---|---|---|---|
| NFC 100-5 + | 80 | 0% | — |
| filler | 80 | 50% | — |
| | 80 | 50% | 2% |
| | 80 | 50% | 5% |
| | 80 | 50% | 10% |
| NFC 100-5 + | 120 | 0% | — |
| filler | 120 | 25% | — |
| | 120 | 50% | — |
| | 120 | 75% | — |

Table 2 shows grammage examples (target values) of nanocellulose-based papers prepared from non-aqueous suspensions (ethanol), including the use of sizing agent (ASA). All listed paper grades have been found to be processable from non-aqueous suspensions and to the porosity range according to the invention.

TABLE 2

| Material | grammage (g/m$^2$) |
|---|---|
| NFC 100-5 | 30 |
| | 60 |
| | 120 |
| NFC (2%) ASA | 60 |

Table 3 shows measurement data on mechanical and optical properties of papers according to the invention and comparative papers. The data is shown graphically in FIG. 2. NFC 5 and NFC 9 refer to the 'water-free' papermaking approach, compared also to other NFC sheet structures made from aqueous suspensions, like NFC 2 and NFC 8.

The NFC 2 and NFC 5 papers were composed of 100 wt-% plain nanofibrillated cellulose 100-5 (ground beech fibers) and the NFC 8 and 9 papers were composed of 100 wt-% ASA-treated nanofibrillated cellulose 100-5 (ground beech fibers) (amount of ASA 2 wt-%). The raw NFC 100-5 was obtained from Rettenmaier & Söhne GmbH, Germany. No other additives, pigments, wood-fibers have been used for those NFC films were contained in the samples tested.

For film formation suspensions of NFC and ASA-NFC, respectively, were prepared in water or ethanol with concentrations in the range of 0.2-1 wt %. The suspensions were homogenized by using a Waring 38-BL40 laboratory blender. Subsequently the sheets were formed in a Büchner funnel by filtration under reduced pressure. The obtained wet NFC sheets were dried at 50° C. between glass plates in a Memmert 400 drying oven.

applying the Washburn equation describing the relation between mercury pressure and pore radius.

Figure 3A:
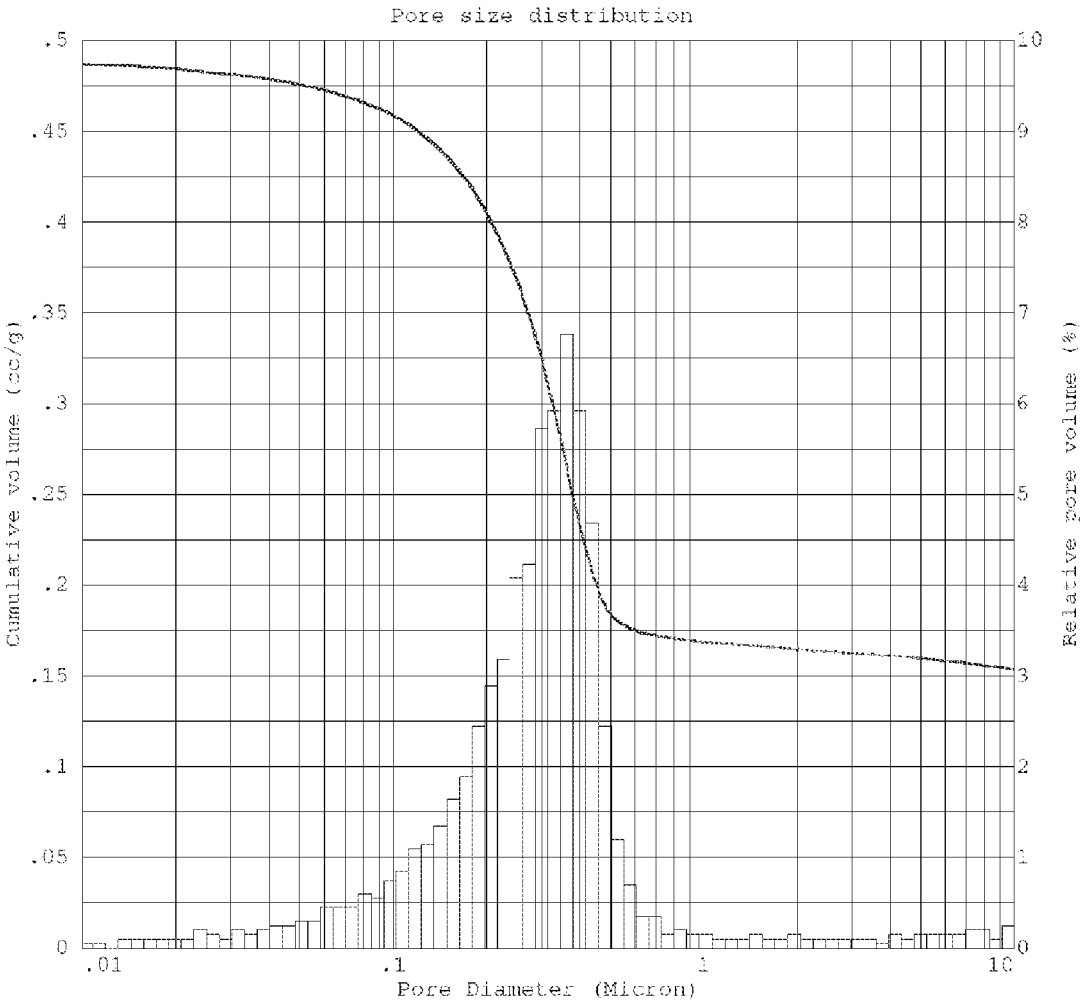
FIGS. 3*a* and 3*b* show pore size distributions of paper sheets manufactured from non-aqueous and aqueous suspensions, respectively.
Figure 3B:
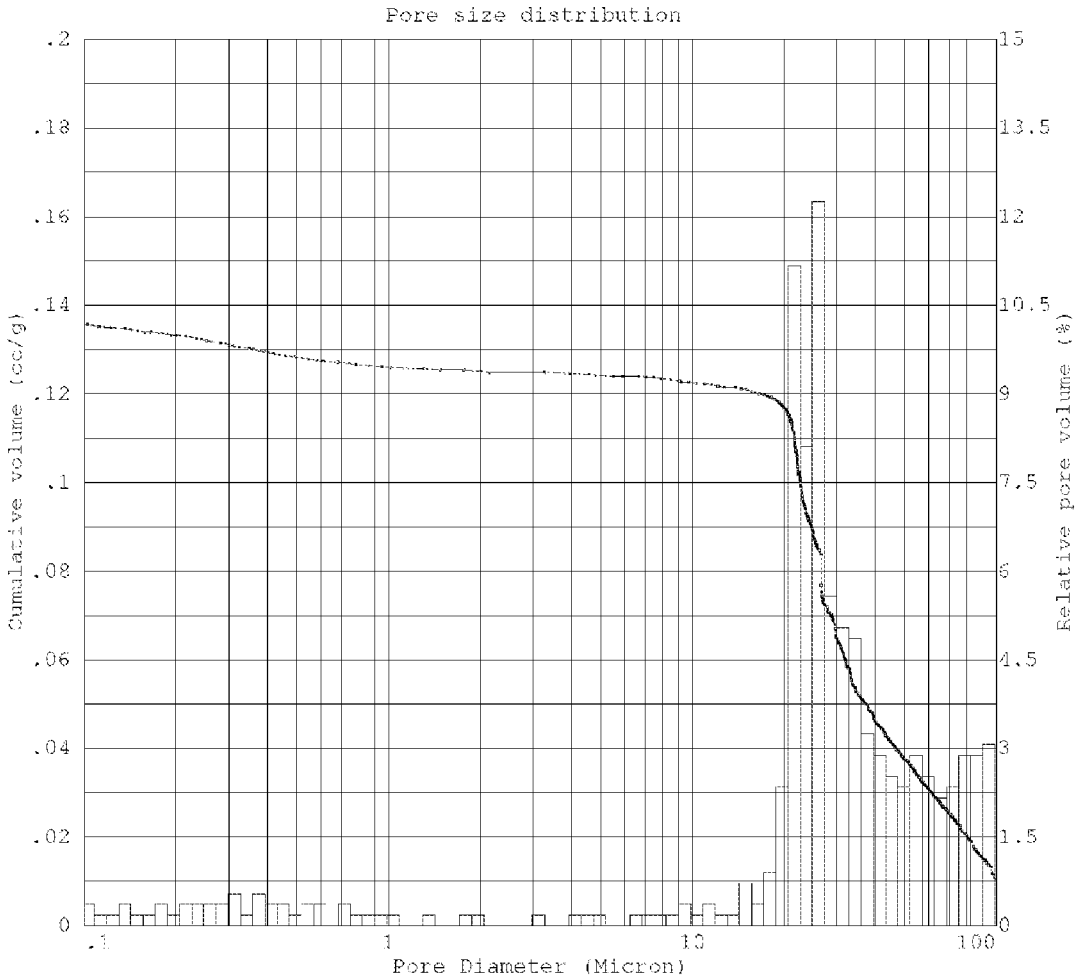

Results of the measurements are shown in FIGS. 3*a* and 3*b*, respectively. The relative pore volume is shown in percentages as vertical bars for a plurality of pore diameter ranges and the cumulative pore volume is shown in cubic centimeters per gram as a curve. As can be seen, the sheet dried from alcohol-based suspension (NFC 5, FIG. 3*a*) contains almost two orders of magnitude smaller pore size than the sheet dried from aqueous suspension (NFC 2, FIG. 3*b*). The average pore size of the former lies in the advantageous range of 200-400 nm, whereas average pore size of the latter is over 20 mm. The indicated dominant geometry of the pores of the NFC sheets is cylindrical.

The embodiments and specific examples disclosed above and illustrated in the attached drawings are non-limiting. The invention is defined in the attached claims which are to be interpreted in their full scope taking equivalents into account.

The invention claimed is:

1. A method of manufacturing nanostructured paper or board, comprising providing a liquid suspension comprising 10-100% by weight of solids in the suspension nanocellulose fibers with a water content of 50% or less by weight of liquids, forming a web from the suspension, drying the web in order to form paper or board, wherein the consistency of the suspension from which the web is formed is at least 3%.

2. The method according to claim 1, wherein the water content of the suspension is 25% or less by weight of liquids.

3. The method according to claim 2, wherein the water content of the suspension is 5% or less by weight of liquids.

TABLE 3

| | | grammage (g/m2) | thickness (microns) | bulk (cm3/g) | air permeance (ml/min) | bright-ness (%) | opacity (%) | tensile strength (kN/m) | Tensile index (Nm/g) | stretch (%) | tensile energy absorption (J/m2 | tensile stiffness (kN/m) | TEA index (J/g) |
|---|---|---|---|---|---|---|---|---|---|---|---|---|---|
| | copy paper MD | 82.2 | 103 | 1.25 | 836 | 97.5 | 90.8 | 4.8 | 58.4 | 1.1 | 34 | 712 | 0.414 |
| | copy paper CD | 82.2 | 103 | 1.25 | 836 | 97.5 | 90.8 | 1.68 | 20.4 | 3.4 | 45 | 207 | 0.547 |
| NFC 2 | NFC 100-5 | 76.7 | 75.8 | 0.99 | 1 | 76.6 | 35.9 | 4.45 | 58.0 | 3.2 | 110 | 321 | 1.434 |
| NFC 5 | NFC 100-5 (ethanol | 72.3 | 139 | 1.93 | 6 | 91.7 | 93.6 | 1.68 | 23.2 | 3.8 | 47.6 | 155 | 0.658 |
| NFC 8 | NFC (2% ASA) | 55.4 | 72.8 | 1.31 | 3 | 86.8 | 71.2 | 1.83 | 33.0 | 1.9 | 23.2 | 166 | 0.419 |
| NFC 9 | NFC-2% ASA (ethanol) | 72.4 | 190 | 2.62 | 413 | 93.2 | 95.2 | 0.437 | 6.0 | 2.4 | 8.2 | 39.6 | 0.113 |

As can be seen from Table 3, ethanol-based suspensions (NFC 5, NFC 9) resulted in thicker, more bulky, brighter and more opaque papers than the comparison papers manufactured from water-based suspensions (NFC 2, NFC 8). Also other properties measured indicate that such papers have the potential of being widely used in similar applications as conventional copy papers.

The pore size distributions of NFC 5 and NFC 2 test papers were measured by mercury intrusion porosimetry (MIP). The method is based on the gradual intrusion of mercury into the pores of the formed NFC sheets. For this purpose a high pressure station, Pascal 440 (Thermo Scientific), was been employed. It allows measurements at high pressures up to 400 MPa and by this the intrusion of pores in the single nanometer range. The experimental data is obtained in form of dependence of filled pore volume upon the applied pressure. These data are converted into a pore size distribution histogram by

4. The method according to claim 1, wherein the consistency of the suspension from which the web is formed is 3-90% (by weight). particular 1-50% by weight.

5. The method according to claim 4, wherein in the consistency of the suspension from which the web is formed is 3-50% by weight.

6. The method according to claim 1, wherein the suspension contains 50-100%, by weight of organic solvent.

7. The method according to claim 6, wherein the suspension contains 90-100%, by weight of said organic solvent.

8. The method according to claim 6, wherein the organic solvent is alcohol.

9. The method according to claim 1, wherein said nanocellulose fibers have a weight average diameter of 10 micrometer or less.

10. The method according to claim 9, wherein the nanocellulose fibers have a weight average diameter of 1 micrometer or less.

11. The method according to claim 9, wherein the nanocellulose fibers have a weight average diameter of 200 nm or less.

12. The method according to claim 1, wherein the suspension comprises reinforcing macrofibers and/or inorganic filler as additives, the amount of additives amounting to 10-90% (by weight of solids). particular 25-75%.

13. The method according to claim 12, wherein the amount of macrofibers is 1-30% (by weight of solids).

14. The method according to claim 13, wherein the amount of macrofibers is 1-10% (by weight of solids).

15. The method according to claim 12, wherein the amount of filler is 10-75% (by weight of solids).

16. The method according to claim 15, wherein the amount of filler is 25-75% (by weight solids).

17. The method according to claim 12, wherein the amount of additives is 25-75% (by weight of solids).

18. The method according to claim 1, wherein the suspension contains hydrophobization agent, in the amount of 0.1-5% by weight.

19. The method according to claim 1, comprising manufacturing paper or board having a porosity of 10-50%.

20. The method according to claim 1, wherein the consistency of the suspension from which the web is formed is at least 5% (by weight).

* * * * *